US008677947B2

(12) United States Patent
Ookubo et al.

(10) Patent No.: US 8,677,947 B2
(45) Date of Patent: Mar. 25, 2014

(54) BOILER SYSTEM

(75) Inventors: Tomohiro Ookubo, Matsuyama (JP); Takashi Morimatsu, Matsuyama (JP); Shigeyoshi Matsugi, Matsuyama (JP); Eiki Suzuki, Matsuyama (JP)

(73) Assignee: Miura Co., Ltd., Matsuyama-shi (JP)

( * ) Notice: Subject to any disclaimer, the term of this patent is extended or adjusted under 35 U.S.C. 154(b) by 478 days.

(21) Appl. No.: 13/075,506

(22) Filed: Mar. 30, 2011

(65) Prior Publication Data

US 2011/0303163 A1 Dec. 15, 2011

(30) Foreign Application Priority Data

Jun. 11, 2010 (JP) ..... 2010-134270
Nov. 2, 2010 (JP) ..... 2010-246882

(51) Int. Cl.
*F22D 5/26* (2006.01)

(52) U.S. Cl.
USPC ..... 122/448.3; 237/8 A

(58) Field of Classification Search
USPC ..... 122/32, 31.1, 406.1, 406.4, 414, 421, 122/448.3; 237/8 A
See application file for complete search history.

(56) References Cited

U.S. PATENT DOCUMENTS

| | | | | |
|---|---|---|---|---|
| 2,676,574 | A * | 4/1954 | Wenzel | 122/451 R |
| 2,780,206 | A * | 2/1957 | La Rocque et al. | 122/448.3 |
| 4,864,972 | A * | 9/1989 | Batey et al. | 122/448.3 |
| 8,271,143 | B2 * | 9/2012 | Deivasigamani et al. | 700/282 |
| 2012/0006285 | A1 * | 1/2012 | Miura et al. | 122/448.3 |
| 2013/0099014 | A1 * | 4/2013 | Kovalcik et al. | 237/8 A |

FOREIGN PATENT DOCUMENTS

| | | | |
|---|---|---|---|
| CN | 201488264 | U | 5/2010 |
| JP | 6-94204 | A | 4/1994 |
| JP | 2002-130602 | | 5/2002 |
| JP | 2002-517706 | A | 6/2002 |
| JP | 2004-190989 | A | 7/2004 |
| JP | 2005-61712 | | 3/2005 |
| JP | 2012013276 | A * | 1/2012 |

* cited by examiner

*Primary Examiner* — Gregory A Wilson
(74) *Attorney, Agent, or Firm* — Fox Rothschild LLP

(57) ABSTRACT

A boiler system has a boiler and a combustion amount control unit. The boiler includes a boiler body, a discharge unit, a discharge passage, a feedwater preheater and a feedwater temperature measuring unit. The feedwater preheater includes a heat exchanger. The feedwater temperature measuring unit measures a feedwater temperature that is the temperature of the feedwater flowing in the heat exchanger. The combustion amount control unit controls combustion amount in the boiler, and has a feedwater temperature threshold as a threshold relating to the feedwater temperature. The combustion amount control unit minimizes the combustion amount in the boiler in a case where the feedwater temperature measured by the feedwater temperature measuring unit is the feedwater temperature threshold or lower.

10 Claims, 7 Drawing Sheets

BOILER SYSTEM

INCORPORATION BY REFERENCE

This application claims priority to Japanese Patent Application Nos. 2010-134270 filed Jun. 11, 2010, and 2010-246882 filed Nov. 2, 2010, the entire contents of which being hereby incorporated herein by reference.

BACKGROUND OF THE INVENTION (1) Field of the Invention

The present invention relates to a boiler system including a boiler and combustion amount control means for controlling combustion amount by the boiler.

(2) Description of the Related Art

In a conventional technique relating to control of a boiler in which in the case where steam or hot water is produced by combustion by a plurality of boilers, the number of boilers in charge of the combustion and combustion amount are calculated such that a steam pressure reaches a target value, so as to increase or decrease the combustion amount by a target boiler.

Alternatively, the boiler has widely used a feedwater preheater (i.e., an economizer) for previously heating (i.e., preheating) water to be fed (i.e., replenished) to the boiler. The feedwater preheater is adapted to, after there is provided a heat exchanger on a discharge passage for combustion gas from the boiler, for thermally exchanging heat of the combustion gas, previously heat (i.e., preheat) feedwater to the boiler with residual heat of the combustion gas in order to enhance the thermal efficiency of the boiler (i.e., boiler efficiency).

In another conventional feedwater preheater, the heat exchanger is disposed in a descendant passage extending downward from above on the discharge passage (i.e., in which the combustion gas descends downward from above). It is construed that one of reasons for the arrangement of the heat exchanger on the descendant passage resides in that condensed water (i.e., drained water) flows in the same direction as that of the descending combustion gas, and thus, the recovery effect of latent heat can be improved by a condensation effect.

In the boiler system including the above-described feedwater preheater for exchanging the heat with the combustion gas in the heat exchanger disposed on the descendant passage of the discharge passage so as to previously heat the feedwater to the boiler by the residual heat of the combustion gas, a low heat radiation loss by the boiler and a high boiler efficiency have been desired. The same goes for the case where the descendant passage is replaced with an ascendant passage in which combustion gas ascends upward from under as a passage on which the combustion gas flows in a vertical direction.

SUMMARY OF THE INVENTION

Therefore, an object of the present invention is to provide a boiler system including the boiler having the above-described feedwater preheater for exchanging the heat with the combustion gas in the heat exchanger disposed on the descendant passage of the discharge passage so as to previously heat the feedwater to the boiler by the residual heat of the combustion gas, so as to reduce a heat radiation loss by the boiler and enhance the boiler efficiency.

According to the present invention, in a boiler system provided with a boiler and combustion amount control means for controlling combustion amount in the boiler, the boiler includes: a boiler body in which combustion is carried out; a discharge unit for discharging combustion gas generated in the boiler body; a discharge passage for allowing the boiler body and the discharge unit to communicate with each other so as to allow the combustion gas to flow therethrough, the discharge passage at least partly having a passage extending in a vertical direction; a feedwater preheater including a heat exchanger which is provided on the passage, for allowing feedwater supplied to the boiler body to flow therethrough, and supplying the feedwater to the boiler body after the feedwater is previously heated in the heat exchanger with the combustion gas flowing on the passage; and feedwater temperature measuring means for measuring a feedwater temperature being the temperature of the feedwater flowing in the heat exchanger; wherein the combustion amount control means has a feedwater temperature threshold as a threshold relating to the feedwater temperature, the combustion amount control means minimizing the combustion amount in the boiler in the case where the feedwater temperature measured by the feedwater temperature measuring means is the feedwater temperature threshold or lower.

It is preferable that the combustion amount control means should set the combustion amount in the boiler to 5% to 35% of the maximum combustion amount when the feedwater temperature measured by the feedwater temperature measuring means ranges from 5° C. to 35° C.

It is preferable that the combustion amount control means should set the combustion amount in the boiler to 40% or more of the maximum combustion amount when the feedwater temperature measured by the feedwater temperature measuring means exceeds the feedwater temperature threshold.

It is preferable that the feedwater temperature threshold should be 40° C. or higher.

It is preferable that the heat radiation loss of the boiler should be 1% or less, and further, the boiler efficiency of the boiler is 96% or more.

It is preferable that the passage should be a descendant passage on which the combustion gas flows downward from above.

It is preferable that the feedwater temperature should be the temperature of the feedwater before the feedwater flows in the heat exchanger.

It is preferable that the plural of boilers should be provided.

It is preferable that the combustion amount control means should control the combustion amount of each of the plurality of boilers in such a manner as to increase the number of boilers which carry out the combustion with the set combustion amount.

According to the present invention, in the boiler system includes the boiler having the above-described feedwater preheater for exchanging the heat with the combustion gas in the heat exchanger disposed on the descendant passage of the discharge passage so as to previously heat the feedwater to the boiler by the residual heat of the combustion gas, it is possible to reduce a heat radiation loss by the boiler and enhance the boiler efficiency.

DESCRIPTION OF THE PREFERRED EMBODIMENTS

Figure 1:
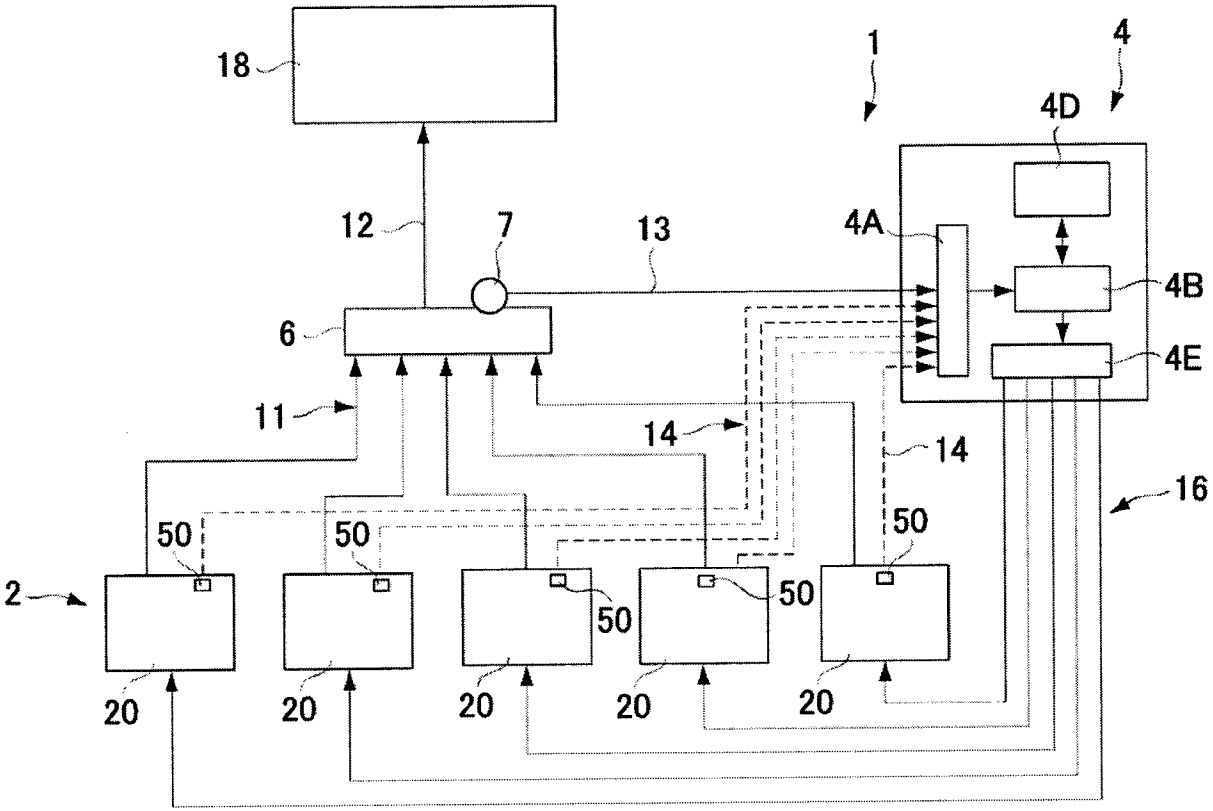
FIG. 1 is a diagram schematically illustrating a boiler system 1 in a preferred embodiment according to the present invention.
Figure 2:
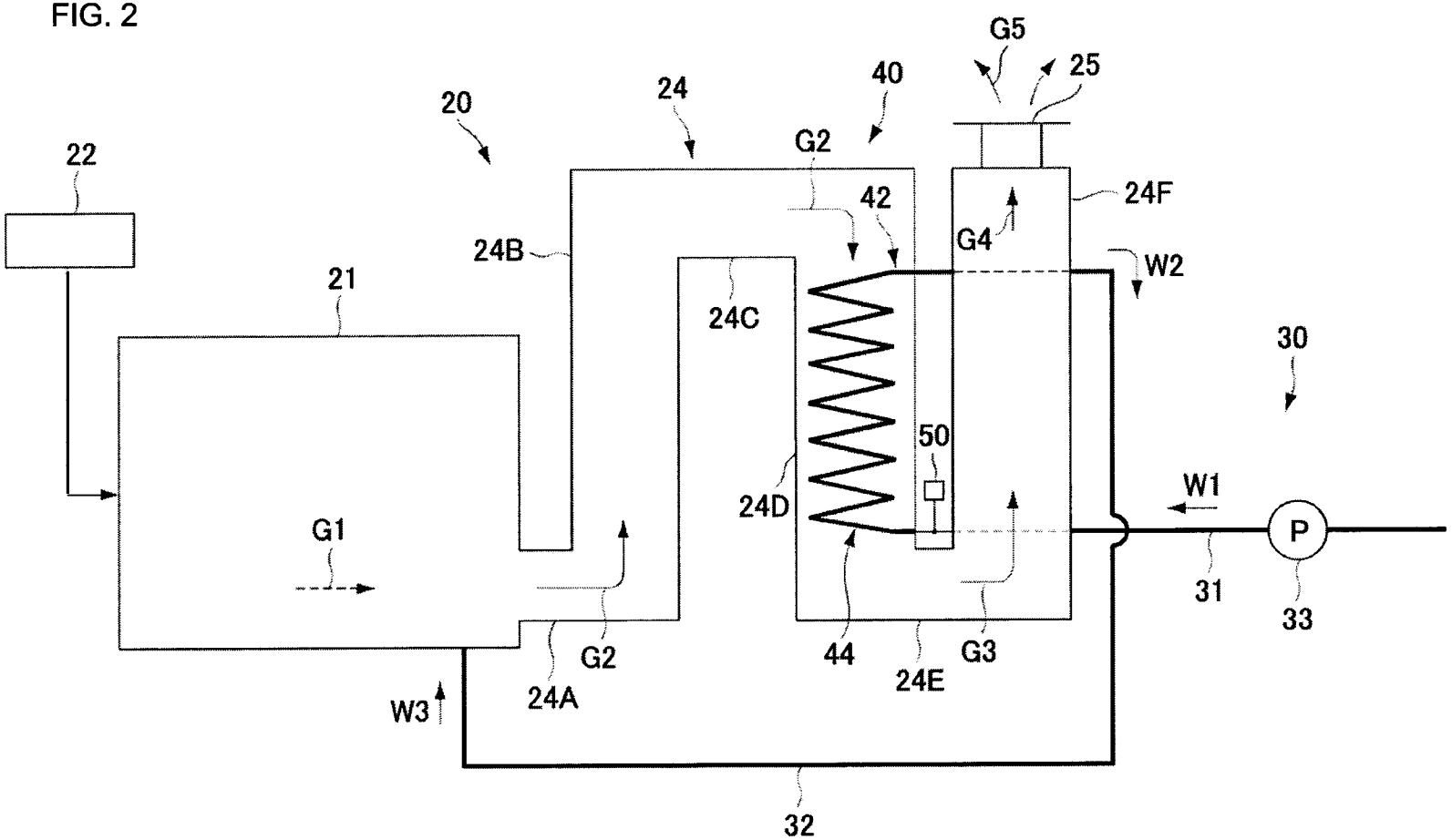
FIG. 2 is a vertically cross-sectional view showing a boiler 20 in the boiler system 1.

Referring to FIGS. 1 and 2, a description will be given below of the boiler system 1 in a preferred embodiment according to the present invention. FIG. 1 is a diagram schematically illustrating the boiler system 1 in a preferred embodiment according to the present invention; and FIG. 2 is a vertically cross-sectional view showing the boiler 20 in the boiler system 1.

As illustrated in FIG. 1, the boiler system 1 in the preferred embodiment includes: a boiler group 2 consisting of a plurality of boilers 20; a combustion amount controller 4 for controlling the respective combustion amounts of the plurality of boilers 20; feedwater temperature measuring units 50 disposed in the plurality of boilers 20, respectively; a steam header 6; and a pressure measuring unit 7 disposed in the steam header 6.

In the boiler system 1 in the preferred embodiment, steam generated in the boiler group 2 can be supplied to steam using facility 18.

A load required in the boiler system 1 is equal to the amount of steam consumed in the steam using facility 18. In the boiler system 1, a steam pressure P inside of the steam header 6 to be controlled is measured by the pressure measuring unit 7, and then, the combustion amount controller 4 is designed to control the number of boilers 20 which is in charge of the combustion, the combustion amount by the boiler 20, or the like based on the measured pressure and a feedwater temperature T, described later, measured by the feedwater temperature measuring unit 50, or the like.

The boiler group 2 consists of, for example, five boilers 20.

In the present preferred embodiment, each of the boilers 20 is constituted of a stepwise value control boiler. Here, the stepwise value control boiler is adapted to selectively turn on or off the combustion or adjust the magnitude of a flame, so as to control the combustion amount, thereby stepwise increasing or decreasing the combustion amount according to the combustion position selected. The stepwise value control boiler can satisfactorily secure the superiority to a proportional control boiler from the viewpoints of facility structure and cost, in which the combustion position is carried out on a few levels.

The combustion amount at each of the combustion positions is designed such that steam is generated by amount corresponding to a difference in steam pressure (to be controlled) in the steam header 6 to be controlled. The five boilers 20, each of which is the stepwise value control boiler, have the same combustion amount and combustion capacity (i.e., the combustion amount in a high combustion state) at each of the combustion positions.

Each of the stepwise value control boilers can be controlled in the following four steps of combustion states (i.e., the combustion position and the load rate), which is of a so-called four-position control type:

1) combustion stoppage state (first combustion position: 0%)

2) low combustion state L (second combustion position: 20%)

3) middle combustion state M (third combustion position: 45%)

4) high combustion state H (fourth combustion position: 100%)

Incidentally, an N-position control represents that the combustion amount by the stepwise value control boiler can be stepwise controlled at an N position inclusive of the combustion stoppage state.

The combustion amount controller 4 controls the combustion amount of each of the plurality of boilers 20 based on the pressure P inside of the steam header 6 measured by the pressure measuring unit 7, the feedwater temperature T measured by the feedwater temperature measuring unit 50, or the like.

The combustion amount controller 4 is provided with an input 4A, a calculator 4B, a database 4D, and an output 4E. In the combustion amount controller 4, the calculator 4B calculates a required combustion amount GN by the boiler group 2 and a combustion state of each of the boilers according to the required combustion amount GN based on a demand load input through the input 4A, and then, the output 4E outputs a control signal to each of the boilers, thereby controlling the combustion by the boiler 20.

The input 4A is connected to the pressure measuring unit 7 via a signal line 13, thus to receive a signal (i.e., a pressure signal) indicating the pressure P inside of the steam header 6 measured by the pressure measuring unit 7.

Moreover, the input 4A is connected to each of the boilers 20 via a signal line 14, thus to receive information on the combustion state of each of the boilers 20, the number of boilers 20 which is in charge of the combustion, and the feedwater temperature T measured by the feedwater temperature measuring unit 50.

The calculator 4B is designed to read a control program stored in a storage medium (e.g., a ROM, i.e., a read only memory), not illustrated, execute the control program so as to calculate the pressure P of the steam inside of the steam header 6 in response to the pressure signal sent from the pressure measuring unit 7, and further, acquire the required combustion amount GN for setting the pressure P within an allowable range of a set pressure PT (i.e., upper and lower pressure limits) by allowing the pressure P and the database 4D to correspond to each other.

In addition, the calculator 4B carries out predetermined calculation relating to the setting of the combustion amount by the boiler 20 based on the feedwater temperature T measured by the feedwater temperature measuring unit 50.

The database 4D stores therein the required combustion amount GN of the boiler group 2 required for adjusting the pressure P inside of the steam header 6 measured by the pressure measuring unit 7 within an allowable range of the setting pressure (i.e., a target pressure) PT.

The output 4E is connected to each of the boilers 20 via a signal line 16. The output 4E is adapted to output a combustion control signal calculated by the output 4B to each of the boilers 20. The combustion control signal includes the number of boilers which are in charge of the combustion, the combustion state (i.e., the combustion amount) of the boiler, and the like.

The steam header 6 is connected downstream to the boiler group 2 (i.e., each of the boilers 20) via a steam pipe 11. In the meanwhile, the steam header 6 is connected upstream to the steam using facility 18 via another steam pipe 12. The steam header 6 is designed to collect the steam generated in the boiler group 2, to adjust a mutual pressure difference among the boilers 20 and pressure fluctuations, hereby supplying the steam whose pressure is adjusted to the steam using facility 18.

The steam using facility 18 is facility to be operated with the steam supplied from the steam header 6.

Next, a description will be given of the configuration of the boiler 20.

As illustrated in FIG. 2, the boiler 20 includes: a boiler body 21 where the combustion is carried out; a discharge unit 25 for discharging combustion gas G4 generated in the boiler body 21; a discharge passage 24 for allowing combustion gases G2 to G4 in communication between the boiler body 21 and the discharge unit 25; a feedwater device 30 for supplying feedwater W1 to W3 to the boiler body 21; an economizer 40 serving as a feedwater preheater for previously heating the feedwater W1, and then, supplying the feedwater W3 to the boiler body 21; and a feedwater temperature measuring unit 50 serving as feedwater temperature measuring means.

In the boiler body 21, fuel supplied from a fuel supplying unit 22 is subjected to combustion by a burner, not illustrated, housed inside of the boiler body 21. Combustion gas G1 caused by the combustion heats water staying inside of a casing, not illustrated, of the boiler body 21, and further, is discharged onto the discharge passage 24 as the combustion gas G2.

As for the combustion gas, the combustion gas staying inside of the boiler body 21 is referred to as "the combustion gas G1," the combustion gas discharged from the boiler body 21 and introduced onto the discharge passage 24 is referred to as "the combustion gas G2," the combustion gas passing a heat exchanger 44, described later, in the economizer 40 to be reduced in temperature is referred to as "the combustion gas G3," the combustion gas inside of the discharge passage 24 and staying in the vicinity of the discharge unit 25 is referred to as "the combustion gas G4," and the combustion gas discharged from the discharge unit 25 and diffused and mixed in the atmosphere in the vicinity of the discharge unit 25 is referred to as "combustion gas mixture air (combustion gas) G5."

As for the feedwater, the feedwater before passing the heat exchanger 44 in the economizer 40 is referred to as "the feedwater W1," the feedwater after being heated in the heat exchanger 44 is referred to as "the feedwater W2," and the feedwater immediately before being supplied to the boiler body 21 is referred to as "the feedwater W3."

The idea of the combustion gas encompasses at least one of fuel gas whose combustion reaction is finished and fuel gas whose combustion reaction is being performed. The combustion gas ranges from the combustion gas which is produced in the boiler body 21 and stays inside of the boiler body 21 to the combustion gas which is discharged from the discharge unit 25 and mixed with the atmosphere into the combustion gas mixture air G5 which stays in the vicinity of the discharge unit 25. The fuel is, for example, fuel gas including raw gas and air for combustion in mixture. Alternatively, the fuel gas may be replaced with liquid fuel such as heavy oil.

The fuel supplying unit 22 includes, for example, an air blowing fan, not illustrated, for supplying air for combustion and a nozzle, not illustrated, for supplying the raw gas to the air for the combustion. The fuel supplying unit 22 is designed to subject the fuel gas containing the air for the combustion blown from the air blowing fan and the raw gas supplied from the nozzle in mixture to the combustion by the burner.

The discharge passage 24 is a passage on which the combustion gas G2 generated by the combustion in the boiler body 21 is fed from the boiler body 21 to the discharge unit 25, so as to discharge the combustion gas G2 to the atmosphere.

The discharge passage 24 is provided in at least a part thereof with a descendant passage 24D extending in a vertical direction. On the descendant passage 24D, the combustion gases G2 and G3 descend and pass downward from above.

More particularly, the discharge passage 24 includes: a first horizontal passage 24A which is connected to the distal end of the boiler body 21 and is formed in a horizontal direction, as viewed sideways; a first ascendant passage 24B which is connected to the first horizontal passage 24A and extends upward; a second horizontal passage 24C which is connected to the first ascendant passage 24B and extends in the horizontal direction; the descendant passage 24D which is connected to the second horizontal passage 24C and extends downward; a third horizontal passage 24E which is connected to the descendant passage 24D and extends in the horizontal direction; and a second ascendant passage 24F which is connected to the third horizontal passage 24E and extends upward.

The discharge unit 25 is formed at the distal end of the second ascendant passage 24F, and is opened to the atmosphere.

The economizer 40 includes a ventilation passage 42, through which the combustion gas G2 passes, and the heat exchanger 44 which exchanges the heat in contact with the combustion gas G2.

The ventilation passage 42 is constituted of the descendant passage 24D in the discharge unit 24.

The heat exchanger 44 is disposed on the descendant passage 24D, and allows the feedwater W1 supplied to the boiler body 21 to pass therethrough. In the economizer 40, the heat exchanger 44 previously heats the feedwater W1 with the combustion gas G2 which is discharged from the boiler body 21 and passes the descendant passage 24D, and then, supplies the feedwater W2 and W3 to the boiler body 21.

The heat exchanger 44 can, for example, recover the sensible heat of the combustion gas G2 or recover the latent heat of the combustion gas G2, so as to condense steam contained in the combustion gas G2, thereby recovering the condensed steam as water.

Subsequently, an explanation will be made on the function of the economizer 40.

1) The combustion gas G1 produced by the combustion of the fuel in the boiler body 21 is discharged onto the discharge passage 24 after the water staying inside of the casing of the boiler body 21 is heated, to be turned into the combustion gas G2.

2) The combustion gas G2 moved onto the discharge passage 24 passes the heat exchanger 44 disposed on the descendant passage 24D of the discharge passage 24. The water staying inside of the heat exchanger 44 is heated by the sensible heat of the combustion gas G2, so that the combustion gas G2 is reduced in temperature. The steam contained in the combustion gas G2 is condensed and separated as the water. And then, the combustion gas G2 is reduced in temperature, to be thus turned into the combustion gas G3.

3) The combustion gas G3 (G4) which passes the heat exchanger 44, to be then reduced in temperature is mixed with the atmosphere in the vicinity of the discharge unit 25, to be thus turned into the combustion gas mixture air G5.

In this manner, since the heat exchanger 44 is disposed on the descendant passage 24D, the water (i.e., the drained water) condensed in the heat exchanger 44 can be readily recovered in a lower portion of the heat exchanger 44.

The feedwater device 30 is a device for supplying the feedwater to the boiler body 21 through the economizer 40.

The feedwater device 30 includes a feedwater tank, not illustrated, a first feedwater line 31, the heat exchanger 44, a second feedwater line 32, and a feedwater pump 33.

The first feedwater line 31 is adapted to connect the feedwater tank to the lower end of the heat exchanger 44, to thus allow the feedwater W1 reserved in the feedwater tank to communicate with the lower end of the heat exchanger 44.

In contrast, the second feedwater line 32 is designed to connect the upper end of the heat exchanger 44 to a lower pipe header, not illustrated, of the boiler body 21, thereby allowing the feedwater W2 passing the heat exchanger 44 to communicate with the lower pipe header of the boiler body 21.

The feedwater pump 33 is disposed on the way of the first feedwater line 31, and thus, feeds the feedwater W1 staying on the first feedwater line 31 downstream (i.e., onto the boiler body 21 side).

The feedwater temperature measuring unit 50 is connected onto the first feedwater line 31 in the vicinity of the heat exchanger 44, to measure the feedwater temperature T of the feedwater W1 before communicating with the heat exchanger 44.

Next, a description will be given of the function according to the control of the combustion amount of the plurality of boilers 20 based on the feedwater temperature T measured by the feedwater temperature measuring unit 50 out of functions of the combustion amount controller 4.

A feedwater temperature threshold Q is set as a threshold relating to the feedwater temperature T in the combustion amount controller 4.

The feedwater temperature threshold Q should preferably fall within a range of, for example, 40° C. or higher, as long as it may be appropriately set within a range from 40° C. to 50° C. (e.g., 45° C.). Here, it may be arbitrarily set within a range of 40° C. or higher and lower than 100° C. When the feedwater temperature threshold Q in the present preferred embodiment is 45° C., the feedwater temperature threshold Q takes a value near the dew point of the combustion gas in the present preferred embodiment.

A heat radiation loss in the boiler 20 in the present preferred embodiment should be preferably 1% or less, more preferably, 0.6% or less.

The "heat radiation loss" herein signifies the total amount of heat radiation losses from the boiler 20, and includes, for example, a loss from the combustion gas (i.e., exhaust gas), a loss from the boiler body 21, a loss from the discharge passage 24, a loss of non-combustion of the fuel, a loss of incomplete combustion gas, and a loss caused by a drain, steam, hot water leakage from each of the parts.

Figure 3:
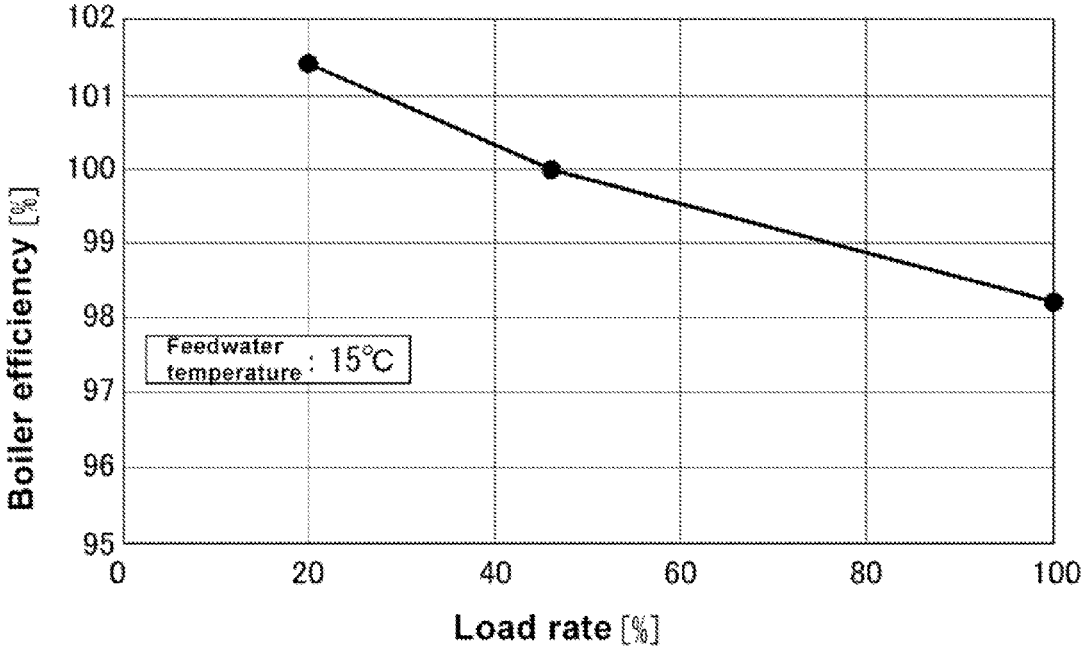
FIG. 3 is a graph illustrating the relationship between a load rate and a boiler efficiency when a feedwater temperature is 15° C.

When the heat radiation loss in the boiler 20 is 1% or less, a tendency is likely to be exhibited that the boiler efficiency is gradually increased as the load rate of the boiler is lower, as illustrated in FIG. 3, described later.

In the present preferred embodiment, the boiler (instant) efficiency of the boiler 20 should be preferably 96% or more, more preferably, 97%.

The "boiler efficiency" herein signifies the rate of total absorption calorie of the steam with respect to the total supply calorie, and namely, is an instant efficiency (i.e., a design efficiency) at a load of 100%.

When the boiler efficiency is 96% or more, the tendency is likely to be exhibited that the boiler efficiency is gradually increased as the load rate of the boiler is lower, as illustrated in FIG. 3, described later.

Like the boiler system 1 in the present preferred embodiment, with the configuration (i.e., a down flow type) in which the heat exchanger 44 of the economizer 40 is disposed on the descendant passage 24D on which the combustion gases G2 and G3 descends downward from above, the condensed water (i.e., the drained water) produced at the upper portion of the heat exchanger 44 flows in the same direction as that of the descending combustion gas, so as to enhance the latent heat recovering effect owing to the condensation effect.

A combustion condition by the boiler 20 on which the boiler efficiency becomes highest according to the feedwater temperature T is varied. This is because, for example, the degree of a decrease in temperature of the combustion gas depends on the feedwater temperature T, so that the condensed water (i.e., the drained water) is variously liable to be produced.

In view of this, in the present preferred embodiment, the combustion amount controller 4 controls the combustion amount of each of the plurality of boilers 20 based on the feedwater temperature T measured by the feedwater temperature measuring unit 50.

More particularly, when the feedwater temperature T measured by the feedwater temperature measuring unit 50 is the feedwater temperature threshold Q or lower, the combustion amount controller 4 sets the smallest combustion amount in each of the plurality of boilers 20.

When the feedwater temperature measured by the feedwater temperature measuring unit 50 ranges from 5° C. to 35° C., the combustion amount controller 4 should preferably set the combustion amount of the boiler 20 to 5% to 35% of the maximum combustion amount. For example, when the feedwater temperature measured by the feedwater temperature measuring unit 50 ranges from 10° C. to 20° C., the combustion amount controller 4 sets the combustion amount of the boiler 20 to 10% to 20% of the maximum combustion amount. Specifically, when the water having a feedwater temperature T of 15° C. (room temperature) is supplied, and further, the combustion gas G2 having a temperature of about 350° C. is introduced into the heat exchanger 44, the combustion amount controller 4 sets the combustion amount of each of the plurality of boilers 20 to the minimum. The minimum combustion amount in the present preferred embodiment is a value in a low combustion state L (i.e., a second combustion position: 20%). Hence, in the present preferred embodiment, the combustion amount controller 4 sets the combustion state of the boiler 20 to the low combustion state L (i.e., a second combustion position: 20%).

In the case where "the combustion amount of the boiler 20 is set to the smallest," the combustion amount excludes amounts in, for example, pilot combustion (inclusive of continuous pilot combustion) and purge combustion (inclusive of soft breeze purge combustion).

Here, the pilot combustion signifies combustion much smaller than low combustion to such an extent as not to prevent any increase in steam pressure in a gas-fired boiler. The pilot combustion can keep a pilot flame state (i.e., a continuous pilot combustion state) by a pilot burner, thereby rapidly proceeding to a next state in intending to increase the combustion amount up to that in a low combustion state or more.

The purge combustion with a soft breeze signifies combustion in which the rotatonal speed of the air blowing fan is decreased to prevent unburned gas from remaining in the casing so as to enable ignition upon an output of a combustion signal in an oil-fired boiler, thereby keeping an air blowing state with a soft breeze.

If neither the pilot combustion nor the purge combustion are set, the heat radiation loss caused by previous purge becomes large, thereby raising a disadvantage of a decrease in boiler efficiency. The reason is because temporary stoppage and restart of the boiler requires the start of combustion after the inside of the casing in the boiler is previously purged.

The previous purge signifies the processing of automatically turning the air blowing fan before the ignition of the boiler, feeding air into a combustion chamber, and expelling the residual gas remaining inside of the combustion chamber to the outside.

The above-described setting is required for the following reason. FIG. 3 is a graph illustrating the relationship between the load rate and the boiler efficiency when the feedwater temperature is 15° C.

In the case where the feedwater temperature T is low (15° C.) (i.e., in the case where the feedwater temperature T is markedly lower than the dew point of the combustion gas), the temperature of the combustion gas G2 is largely decreased, and therefore, the condensed water (i.e., the drained water) is liable to be largely produced at the outer surface of the heat exchanger 44. Moreover, the lower the load rate is, the smaller the latent heat loss of the combustion gas (i.e., the exhaust gas) becomes. For these factors, as illustrated in FIG. 3, the lower the load rate of the boiler is, the more the boiler efficiency tends to be gradually increased. In addition, when the combustion amount is decreased, the temperature of the combustion gas G3 passing the economizer 40 can become smaller. As a consequence, the combustion amount controller 4 sets the combustion state of the boiler 20 to the low combustion state L (the second combustion position: 20%).

On the other hand, in the case where the feedwater temperature T measured by the feedwater temperature measuring unit 50 exceeds the feedwater temperature threshold Q, the combustion amount controller 4 preferably sets the combustion amount of each of the plurality of boilers 20 to 40% or more of the maximum combustion amount, for example, to 40% to 70%.

Specifically, in the case where hot feedwater having a feedwater temperature T of 45° C. is supplied and the combustion gas G2 having a temperature of about 350° C. is introduced into the heat exchanger 44, the combustion amount controller 4 sets the combustion amount of each of the plurality of boilers 20 to 40% to 70% of the maximum combustion amount. In the present preferred embodiment, a middle combustion state M (the third combustion position: 45%) fall within a range of 40% to 70% of the maximum combustion amount. In the present preferred embodiment, the combustion state of the boiler 20 is set to the middle combustion state M (the third combustion position: 45%).

Figure 4:
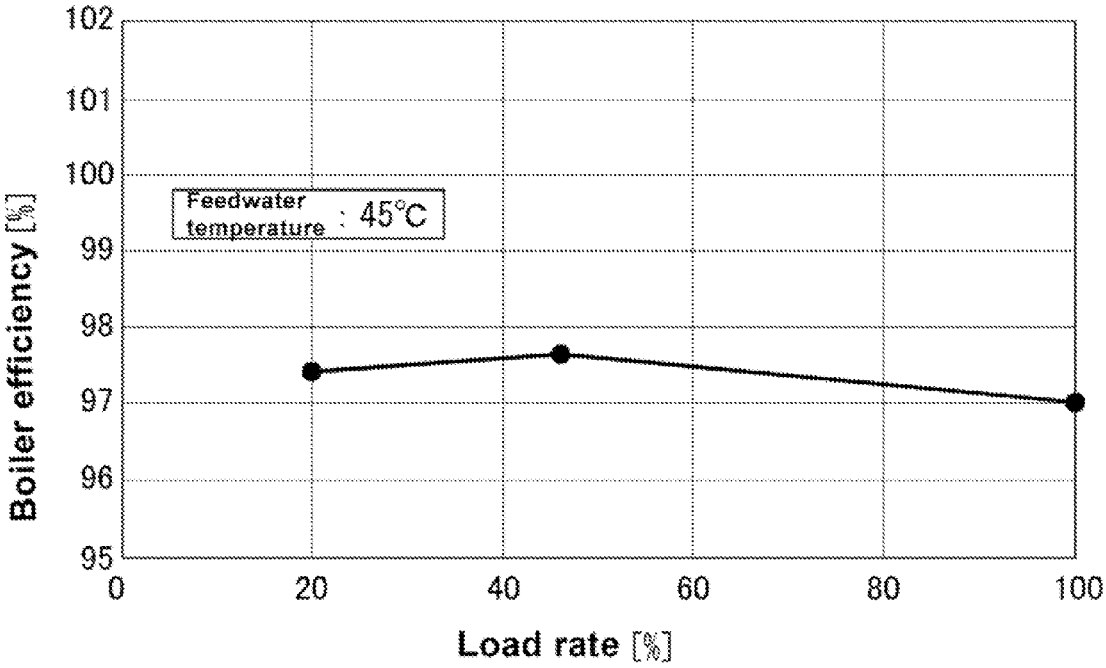
FIG. 4 is a graph illustrating the relationship between the load rate and the boiler efficiency when a feedwater temperature is 45° C.

The above-described setting is required for the following reason. FIG. 4 is a graph illustrating the relationship between the load rate and the boiler efficiency when the feedwater temperature is 45° C.

In the case where the feedwater temperature T is high (45° C.) (i.e., in the case where the feedwater temperature T is near the dew point of the combustion gas), the lower the load rate is, the greater the influence of the heat radiation loss becomes: in contrast, the higher the load rate is, the greater the latent heat loss of the combustion gas (i.e., the exhaust gas) becomes. For these factors, as illustrated in FIG. 4, in the case where the state of the boiler having the middle load rate is the middle combustion state M (the third combustion position: 45%), the boiler efficiency becomes remarkably high (i.e., a peak). Consequently, the combustion amount controller 4 sets the combustion state of the boiler 20 to the middle combustion state M (the third combustion position: 45%).

Additionally, the combustion amount controller 4 controls the combustion amount of each of the plurality of boilers 20 such that the number of boilers 20 which are subjected to the combustion at the set combustion amount is increased one by one.

For example, in the case where the combustion state of the boiler 20 is set to a low combustion state L (the second combustion position: 20%), the combustion amount controller 4 first subjects one boiler 20 to the combustion in the low combustion state L (the second combustion position: 20%), the combustion amount controller 4 first subjects one boiler 20 to the combustion in the low combustion state L (the second combustion position: 20%). When the combustion by one boiler 20 produces steam in insufficient amount (i.e., required amount) in the boiler system 1, a second boiler 20 is subjected to the combustion in the low combustion state L (the second combustion position: 20%). The number of boilers 20 to be subjected to the combustion in the low combustion state L (the second combustion position: 20%) is increased until the required steam amount is achieved. In the case where the required steam amount cannot be achieved even if all of the boilers 20 are subjected to the combustion in the low combustion state L (the second combustion position: 20%), the combustion state of one of the boilers 20 is set to the middle combustion state M (the third combustion position: 45%). The number of boilers 20 subjected to the combustion in the middle combustion state M (the third combustion position: 45%) hereafter is increased until the require steam amount is achieved.

Also when the combustion state of the boilers 20 is set in the middle combustion state M (the third combustion position: 45%) from the beginning, the control is performed in the same manner as described above.

Incidentally, the number of boilers 20 may be increased at one time.

Figure 5:
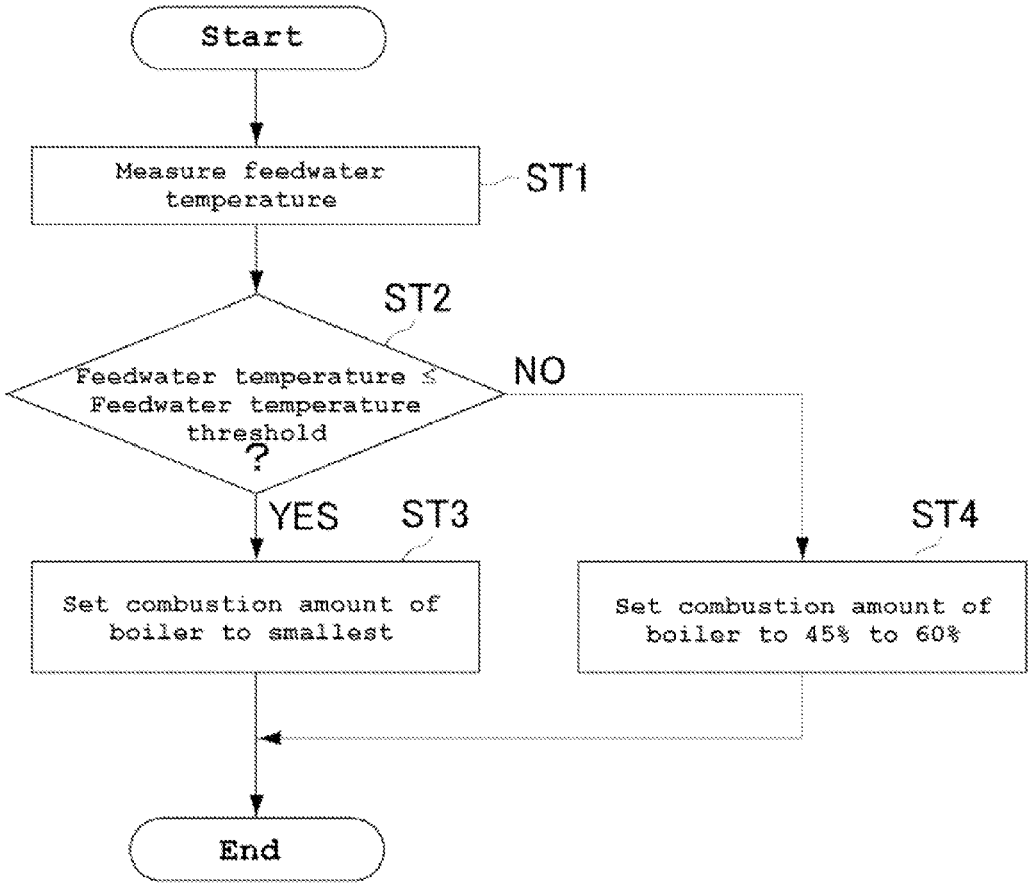
FIG. 5 is a flowchart illustrating the operation of the boiler system 1 in the preferred embodiment.

Subsequently, a description will be given of the control of the combustion amount of the boiler 20 based on the feedwater temperature T of the feedwater W1 before passing the heat exchanger 44 in the boiler system 1 in the present preferred embodiment with reference to FIG. 5. FIG. 5 is a flowchart illustrating the operation of the boiler system 1 in the preferred embodiment.

As illustrated in FIG. 5, in step ST1, the feedwater temperature measuring unit 50 measures the feedwater temperature T of the feedwater W1 before passing the heat exchanger 44. The information on the feedwater temperature T measured by the feedwater temperature measuring unit 50 is input into the calculator 4B through the input 4A in the combustion amount controller 4.

In step ST2, the calculator 4B in the combustion amount controller 4 determines whether or not the feedwater temperature T is the feedwater temperature threshold Q or lower. If the feedwater temperature T is the feedwater temperature threshold Q or lower (YES), the control routine proceeds to step ST3. In contrast, if the feedwater temperature T exceeds the feedwater temperature threshold Q (NO), the control routine proceeds to step ST4.

If the feedwater temperature T is the feedwater temperature threshold Q or lower (YES), the boiler efficiency can become highest by setting the combustion amount of each of the plurality of boilers 20 to the smallest value. In the present preferred embodiment, the smallest combustion amount is achieved in the low combustion state L (the second combustion position: 20%). In view of this, in step ST3, the calculator 4B in the combustion amount controller 4 sets the combustion amount of each of the plurality of boilers 20 to that in the low combustion state L (the second combustion position: 20%).

In contrast, if the feedwater temperature T exceeds the feedwater temperature threshold Q (NO), the boiler efficiency can become highest by setting the combustion amount of each of the plurality of boilers 20 to, for example, 40% to 70% of the maximum combustion amount. In the present preferred embodiment, the combustion amount in the middle combustion state M (the third combustion position: 45%) corresponds to 40% to 70% of the maximum combustion amount. Hence, in step ST4, the calculator 4B in the combustion amount controller 4 sets the combustion amount of each of the plurality of boilers 20 to that in the middle combustion state M (the third combustion position: 45%).

After step ST3 or step ST4, the control of the combustion amount of the boiler 20 based on the feedwater temperature T of the feedwater W1 before passing the heat exchanger 44 comes to an end. Thereafter, the combustion amount controller 4 controls the combustion amount of the boiler 20 based on the pressure P of the steam or the like inside of the steam header 6, measured by the pressure measuring unit 7.

Figure 6:
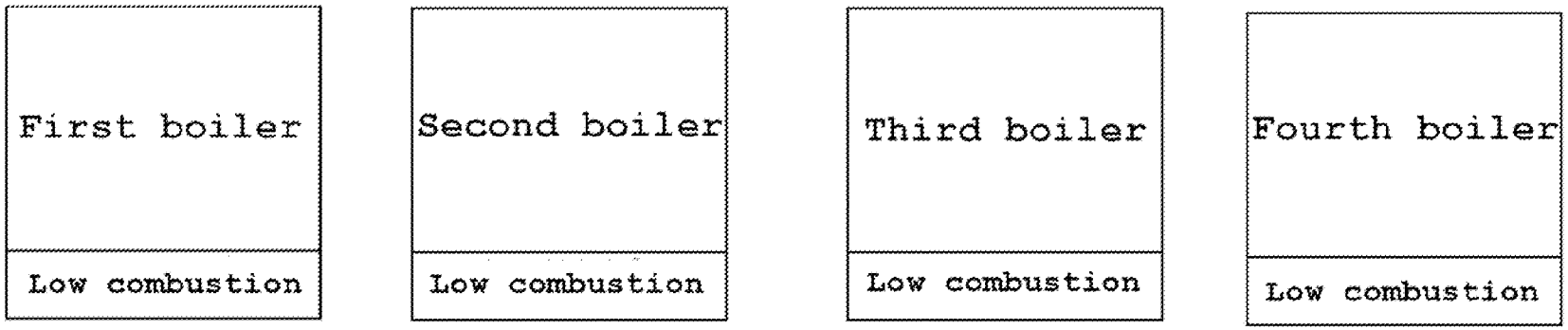
FIG. 6 is a diagram illustrating a first specific example relating to control of combustion amount by the boiler.
Figure 7:
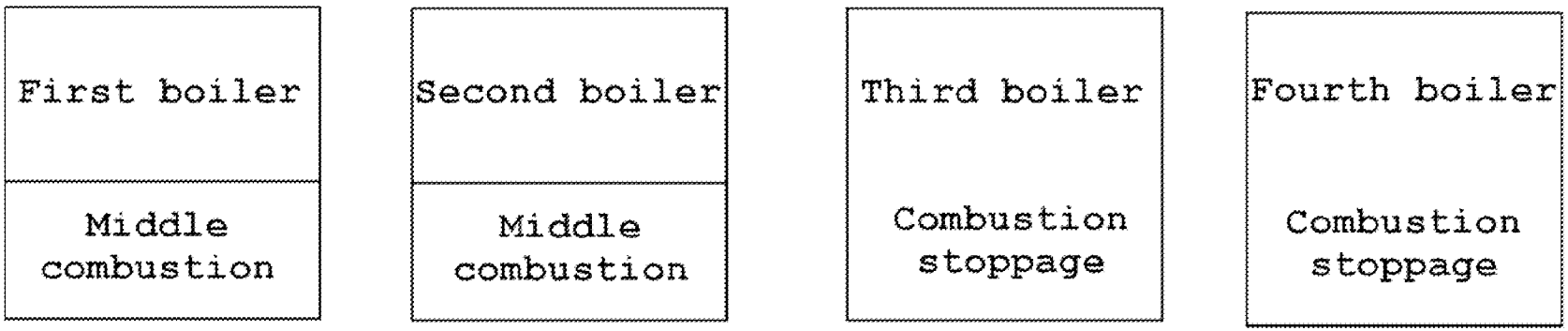
FIG. 7 is a diagram illustrating a second specific example relating to control of combustion amount by the boiler.

Next, an explanation will be made on specific examples of the control of the combustion amount (first and second specific examples) with reference to FIGS. 6 and 7. FIG. 6 is a diagram illustrating the first specific example relating to the control of the combustion amount by the boiler; and FIG. 7 is a diagram illustrating the second specific example relating to the control of the combustion amount by the boiler.

These specific examples are made under the following conditions. As illustrated in FIGS. 6 and 7, the boiler system includes four boilers (first to fourth). One of the boilers has a steam productivity of 2 t/h. The required steam amount is 2 t. The steam productivity of the boiler is 500 kg/h when the boiler is set in the low combustion state L (the second combustion position: 20%). In contrast, the steam productivity of the boiler is 1 t/h when the boiler is set in the middle combustion state M (the third combustion position: 45%).

Under the above-described condition, in the case where the feedwater having a feedwater temperature T of 15° C. (room temperature) is supplied and the combustion gas having a temperature of about 350° C. is introduced to the heat exchanger, all of the four boilers are set to the combustion amount in the low combustion state L (the second combustion state: 20%), as illustrated in FIG. 6. Since there are four boilers, each having a steam productivity of 500 kg/h, the total steam productivity in the boiler system becomes 2 t/h which is equal to the required steam amount.

The boiler efficiency can be maximized by controlling the combustion amount in the above-described manner.

On the other hand, under the above-described condition, in the case where the hot feedwater having a feedwater temperature T of 45° C. is supplied and the combustion gas having a temperature of about 350° C. is introduced to the heat exchanger, only the first and second boilers out of the four boilers are set to the combustion amount in the middle combustion state M (the third combustion state: 45%), as illustrated in FIG. 7. Here, the third and fourth boilers are in the combustion stoppage state. Since there are two boilers having a steam productivity of 1 t/h, the total steam productivity in the boiler system becomes 2 t/h which is equal to the required steam amount.

The boiler efficiency can be maximized by controlling the combustion amount in the above-described manner.

The boiler system 1 in the present preferred embodiment produces the following effects, for example.

In the boiler system 1 in the present preferred embodiment, the boiler 20 includes: the discharge passage 24 for allowing the boiler body 21 and the discharge unit 25 to communicate with each other so as to allow the combustion gases G2 to G4 to flow therethrough, the discharge passage 24 partly having the descendant passage 24D extending in the vertical direction; the heat exchanger 44 which is disposed on the descendant passage 24D, and further, through which the feedwater W1 supplied to the boiler body 21 flows; the economizer 40 for previously heating the feedwater W1 in the heat exchanger 44 with the combustion gas G2 flowing on the descendant passage 24D and then supplying the feedwater W3 to the boiler body 21; and the feedwater temperature measuring unit 50 for measuring the feedwater temperature T which is the temperature of the feedwater W1 before flowing in the heat exchanger 44. Moreover, the combustion amount controller 4 controls the combustion amount of each of the plurality of boilers 20 based on the feedwater temperature T measured by the feedwater temperature measuring unit 50.

In the present preferred embodiment, the combustion amount of each of the plurality of boilers 20 is controlled based on the feedwater temperature T which is the temperature of the feedwater W1 before flowing in the heat exchanger 44. As a consequence, it is easy to set the heat radiation loss of the boiler 20 to 1% or less, and further, to set the boiler efficiency of the boiler 20 to 96% or more. Thus, in the present preferred embodiment, it is possible to reduce the heat radiation loss of the boiler 20, and further, to enhance the boiler efficiency.

Although the preferred embodiment has been described above, the present invention is not limited to the above-described preferred embodiment, and it can be embodied in various modes.

For example, the passage on which the heat exchanger 44 is disposed on the discharge passage 24 is the descendant passage 24D, on which the combustion gas descends and flows downward from above in the above-described preferred embodiment, but it is not limited to this. The passage may be an ascendant passage, on which the combustion gas ascends and flows upward from below.

Additionally, in the present preferred embodiment, the boiler 20 is the stepwise value control boiler of the four-position control type which can be controlled at the combustion positions in the four steps (the combustion position, the load rate): the combustion stoppage state (the first combustion position: 0%); the low combustion state L (the second combustion position: 20%); the middle combustion state M (the third combustion position: 45%); the high combustion state H (the fourth combustion position: 100%), but it is not limited to this.

The stepwise value control boiler of the four-position control type may be another stepwise value control boiler of a four-position control type which can be controlled at the combustion positions in the following four steps (the combustion position, the load rate): the combustion stoppage state (the first combustion position: 0%); the low combustion state L (the second combustion position: 20%); the middle combustion state M (the third combustion position: 60%); the high combustion state H (the fourth combustion position: 100%).

The control of the combustion position in the stepwise value control boiler is not limited to the four-position control, and may be three-position control or five-position control.

The feedwater temperature threshold is preferably 40° C. or higher, and should preferably range from 40° C. to 50° C. (e.g., 45° C.) in the preferred embodiment, although it may be set within any range unless it ranges from 40° C. or higher to less than 100° C.

The number of boilers in the boiler system may be one.

The boiler system may include boilers having various steam productivities (e.g., a boiler having a steam productivity of 2 t/h and a boiler having a steam productivity of 3 t/h).

The stepwise value control boiler may be replaced with a proportional control boiler.

A proportional control boiler is designed such that its combustion amount can be continuously controlled within a range from 0% (no combustion state) to 100% (maximum combustion amount) with respect to combustion capacity (i.e., combustion amount in maximum combustion state). For example, the proportional control boiler can control the opening degree (i.e., a combustion ratio) of a proportional control valve so as to adjust the combustion amount.

The combustion amount in the proportional control boiler is determined by the product obtained by multiplying the combustion capacity of the proportional control boiler by the valve opening degree (i.e., the combustion ratio).

The continuous control of the combustion amount in the proportional control boiler signifies: amount controlled by a control mechanism such as a valve is set to a numerical value (e.g., 1% or less) smaller than fluctuations of combustion amount caused by variations of the combustion air or the fuel gas even when the combustion amount is stepwise handled by digital calculation or signal in the controller in addition to control of combustion amount in no step, that is, actually continuous control.

Furthermore, the present invention may be applied to a gas-fired boiler and an oil-fired boiler.

What is claimed is:

1. A boiler system comprising:

a boiler including a boiler body configured to carry out combustion, a discharge unit configured to discharge combustion gas generated in the boiler body, a discharge passage configured to allow the boiler body and the discharge unit to communicate with each other, and allow the combustion gas to flow therethrough, the discharge passage at least partly having a passage extending in a vertical direction, a feedwater preheater including a heat exchanger which is provided on the passage, configured to allow feedwater supplied to the boiler body to flow therethrough, and supply the feedwater to the boiler body after the feedwater is previously heated in the heat exchanger with the combustion gas flowing on the passage, and a feedwater temperature measuring unit configured to measure a feedwater temperature being the temperature of the feedwater flowing in the heat exchanger; and a combustion amount control unit configured to control combustion amount in the boiler, having a feedwater temperature threshold as a threshold relating to the feedwater temperature, the combustion amount control unit minimizing the combustion amount in the boiler in a case where the feedwater temperature measured by the feedwater temperature measuring unit is the feedwater temperature threshold or lower.

2. A boiler system according to claim 1, wherein the combustion amount control unit sets the combustion amount in the boiler to 5% to 35% of the maximum combustion amount when the feedwater temperature measured by the feedwater temperature measuring unit ranges from 5° C. to 35° C.

3. A boiler system according to claim 2, wherein the combustion amount control unit sets the combustion amount in the boiler to 40% or more of the maximum combustion amount when the feedwater temperature measured by the feedwater temperature measuring unit exceeds the feedwater temperature threshold.

4. A boiler system according to claim 1, wherein the combustion amount control unit sets the combustion amount in the boiler to 40% or more of the maximum combustion amount when the feedwater temperature measured by the feedwater temperature measuring unit exceeds the feedwater temperature threshold.

5. A boiler system according to claim 1, wherein the feedwater temperature threshold is 40° C. or higher.

6. A boiler system according to claim 1, wherein the heat radiation loss of the boiler is 1% or less, and further, the boiler efficiency of the boiler is 96% or more.

7. A boiler system according to claim 1, wherein the passage is a descendant passage on which the combustion gas flows downward from above.

8. A boiler system according to claim 1, wherein the feedwater temperature signifies the temperature of the feedwater before the feedwater flows in the heat exchanger.

9. A boiler system according to claim 1, wherein the plural of boilers are provided.

10. A boiler system according to claim 9, wherein the combustion amount control unit controls the combustion amount of each of the plurality of boilers in such a manner as to increase the number of boilers which carry out the combustion with the set combustion amount.

* * * * *